US007997521B1

(12) United States Patent
Henson

(10) Patent No.: US 7,997,521 B1
(45) **Date of Patent: *Aug. 16, 2011**

(54) TENSION CONTROL SYSTEM FOR A CONTINUOUS WINDING MACHINE

(75) Inventor: Dale L. Henson, San Jose, CA (US)

(73) Assignee: Dale Henson, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/849,790

(22) Filed: Aug. 3, 2010

Related U.S. Application Data

(63) Continuation of application No. 12/069,230, filed on Feb. 8, 2008, now Pat. No. 7,891,597.

(51) Int. Cl.
*B65H 54/64* (2006.01)
*B21B 39/08* (2006.01)

(52) U.S. Cl. ..... 242/438.1; 242/439.6; 57/11; 57/352; 72/11.4; 72/205

(58) Field of Classification Search ..... 242/563, 242/563.1, 564, 413, 413.1, 413.3, 418, 418.1, 242/147 R, 437, 438.1, 439.2, 439.5, 439.6, 242/441; 57/10–13, 18, 352; 72/142, 143, 72/135, 138, 8.6, 11.4, 12.3, 12.4, 205
See application file for complete search history.

(56) References Cited

U.S. PATENT DOCUMENTS

| | | | | |
|---|---|---|---|---|
| 4,059,239 | A | 11/1977 | Hori et al. | |
| 4,151,594 | A | 4/1979 | Stern | |
| 4,538,772 | A | 9/1985 | Davies | |
| 4,984,749 | A | 1/1991 | Matsui et al. | |
| 5,080,295 | A | 1/1992 | Hongo et al. | |
| 5,470,005 | A | 11/1995 | King et al. | |
| 6,199,361 | B1 | 3/2001 | Yakushi et al. | |
| 6,527,216 | B2 | 3/2003 | Eagelman et al. | |
| 6,851,593 | B2 | 2/2005 | Weber et al. | |
| 7,891,597 | B1 * | 2/2011 | Henson | 242/438.1 |
| 2002/0166917 | A1 | 11/2002 | Eagelman et al. | |
| 2004/0155140 | A1 | 8/2004 | Mast et al. | |
| 2005/0173579 | A1 | 8/2005 | Barea | |
| 2006/0107644 | A1 | 5/2006 | Dye et al. | |
| 2007/0138331 | A1 | 6/2007 | Bett et al. | |

* cited by examiner

*Primary Examiner* — William A Rivera
(74) *Attorney, Agent, or Firm* — Carr & Ferrell LLP

(57) ABSTRACT

A continuous winding machine uses embedded controllers to monitor and control the winding settings in maximum speed applications. Power is supplied to the embedded controllers from a main power source through a rotary transformer. The control system can be operated either through wired connections to a local computer or processor, or through a wireless system, or a combination of both, depending on the specific application. The machine uses a high speed, closed loop tensioning system that includes the filament supply spools and the mandrel supply and takeup spools. The control system menu includes the various winding operations useful to each user. The control system menu can be accessed remotely via computer, or by telephone.

7 Claims, 5 Drawing Sheets

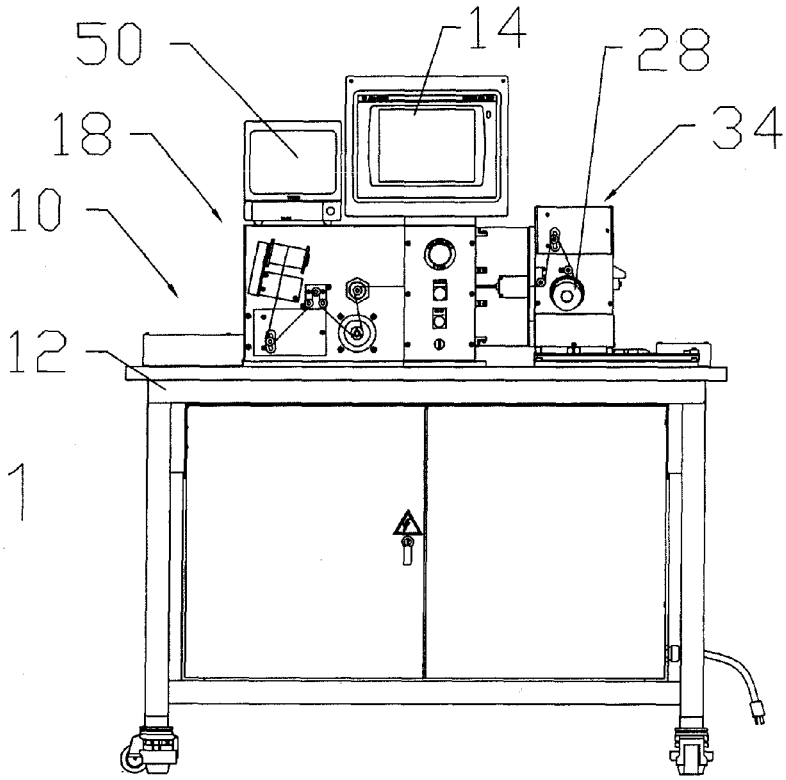
Fig. 1
Fig. 2
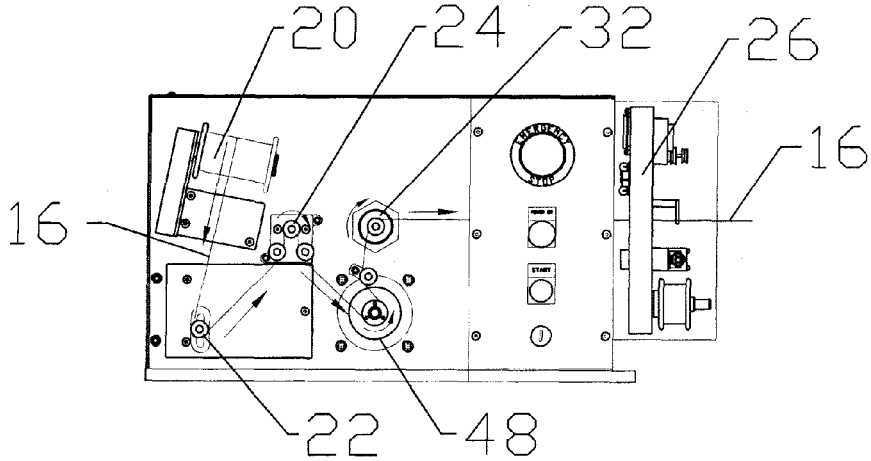

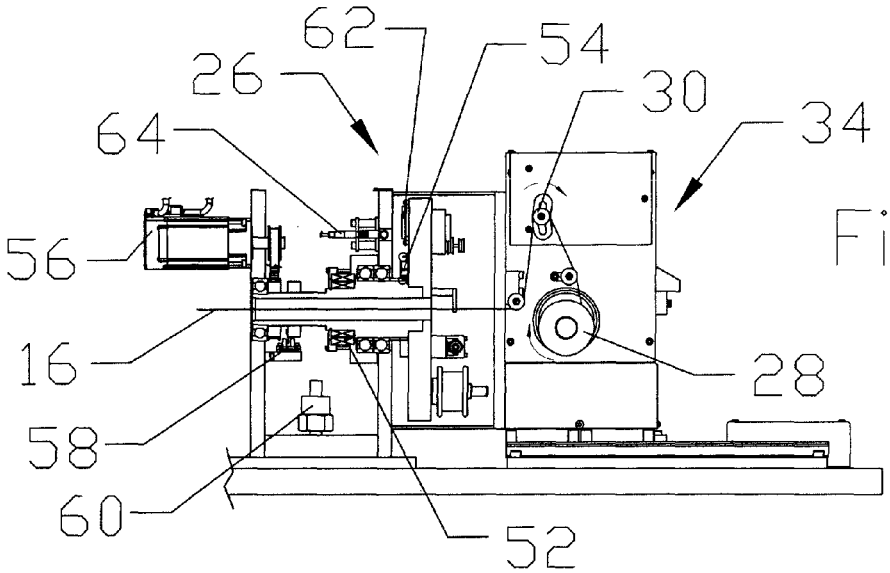
Fig.3
Fig.4
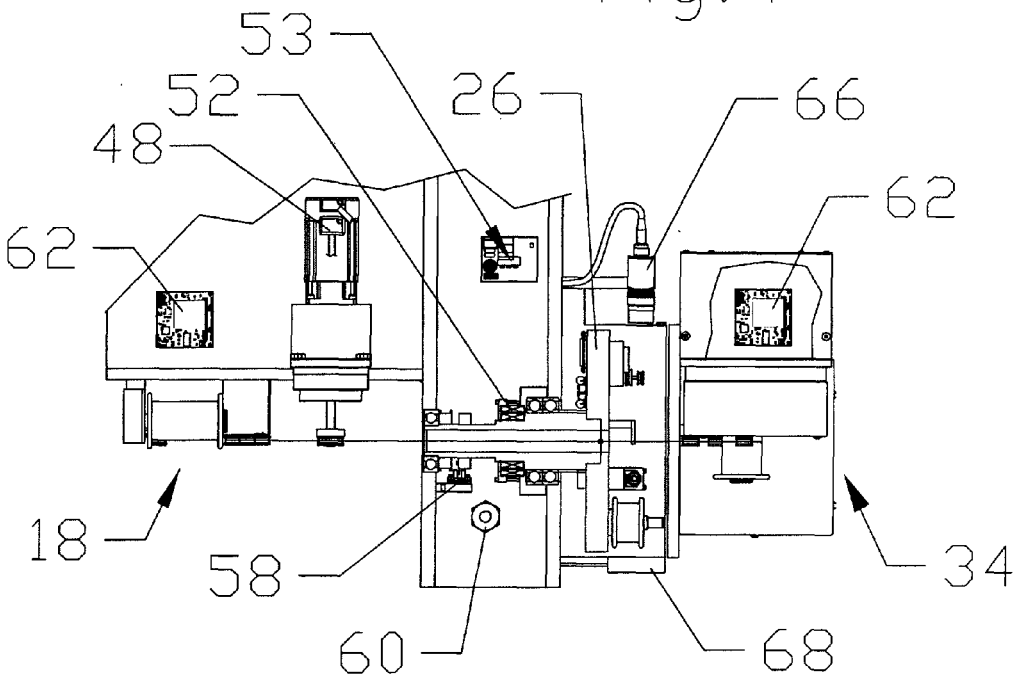

TENSION CONTROL SYSTEM FOR A CONTINUOUS WINDING MACHINE

CROSS-REFERENCE TO RELATED APPLICATION

This application is a Continuation of U.S. patent application Ser. No. 12/069,230 filed Feb. 8, 2008 now U.S. Pat. No. 7,891,597.

BACKGROUND OF THE INVENTION

1. Field of the Invention

The present invention relates generally to tension control systems, and more particularly is an improved tension control mechanism for a continuous winding machine that utilizes wireless or wired embedded closed loop feedback systems.

2. Description of the Prior Art

Coil winding technology has existed for quite some time in various fields. For example, the textile industry has long used winding methods to spool threads and yarns. Some examples of references in this area are the "Method and Apparatus for Winding a Thread on a Bobbin at a High Winding Speed" by Hori, et al., U.S. Pat. No. 4,059,239, issued Nov. 22, 1977; "Winding Apparatus" by Davies, U.S. Pat. No. 4,538,772, issued Sep. 3, 1985; and the "Operation Controlling Method for Textile Machine" of Matsui, et al., U.S. Pat. No. 4,984,789, issued Jan. 15, 1991. Another large subset of winding machines is directed to the art of coil winding for electric motor armatures. See, e.g., "Wire Tensioner for a Wire Handling Machine" by Hongo, et al., U.S. Pat. No. 5,080,295, issued Jan. 14, 1992.

A newer area for the application of winding technology is in the medical devices field. Catheters and stents are constructed by wrapping fine wires around a central mandrel. Current technology catheters and stents require the use of very fine wire filaments wrapped around proportionally small mandrels with winding angles that must be very accurately controlled. The very small diameters of the elements involved and the tight tolerances required make it difficult for current art equipment to construct the coils to the required specifications and without breakage.

One disadvantage of the prior art devices is that they typically use only one-way feed friction control, which produces filament tension that varies with feed rate. While this methodology is acceptable for applications using relatively large filament sizes, for the smaller filament sizes required in, for example, current art medical devices, the forces involved in commonly used feed rate control techniques are not acceptable The force necessary to control the feed rate is greater than the filament can withstand, so that breakage occurs.

Another disadvantage of the prior art devices is that the non-distributed control systems are too large and require too many control wires to enable an independent filament dispenser to spin around a mandrel, as continuous winding requires. The communication required to process information from the sensors to drive the necessary control motors in the machines controlling computer cannot be interrupted.

A further disadvantage of prior art systems that use control systems separate from the filament dispensing control is that multiple slip rings are required to operate with the supply spools rotating around the mandrel. The slip rings wear out quickly, and create debris that is unacceptable in cleanroom environments.

Accordingly, it is an object of the present invention to provide a continuous winding machine with embedded, closed loop tension control to enable production with much finer filament sizes and to tighter tolerances than is possible in prior art systems.

It is another object of the present invention to provide a winding machine that can be operated by both wireless data and wired data control systems.

Yet another object of the present invention is to provide a system that can be programmed for multiple winding parameters, and to provide a system in which the programming can be accomplished remotely.

SUMMARY OF THE INVENTION

The present invention is a continuous winding machine. For maximum speed and control applications, the machine uses an embedded controller to monitor the dispensing of wind filament. The embedded controllers can be operated either through wired connections to a local PLC (programmable logic controller), or through a wireless system, or a combination of both, depending on the specific application. The use of embedded controllers greatly reduces the amount of wiring used in the machine, inasmuch as the wired connections are used only to transfer data between the embedded controllers and the PLC.

The machine uses multiple closed loop tensioning systems that include the filament supply spools and the mandrel supply spool and takeup spool. The control system menu includes the various winding operations useful to each user. The control system menu can be accessed locally through a touch screen or remotely via computer, or by telephone.

An advantage of the present invention is that the machine can wind to tolerances much tighter than those of current art machines.

Another advantage of the present invention is that the wind angle can be controlled to vary the preload, or stiffness, of the coil product.

Yet another advantage of the present invention is that it can more easily handle thin filaments.

A still further advantage of the present invention is that the programming control can be accomplished by remote access means.

Still another advantage of the present invention is that the machine provides automatic counterbalancing of the winding module.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIG. 1 is a front view of the continuous winding machine of the present invention.

FIG. 2 is a front view of the mandrel feed and winding mechanisms.

FIG. 3 is a front view of the winding mechanisms and the mandrel takeup assembly with the winding mechanism shown in greater detail.

FIG. 4 is a top plan view showing the mandrel supply, mandrel takeup, and winding mechanisms in conjunction with the machine vision used for angle sensing and pitch control.

DETAILED DESCRIPTION OF THE INVENTION

Figure 5:
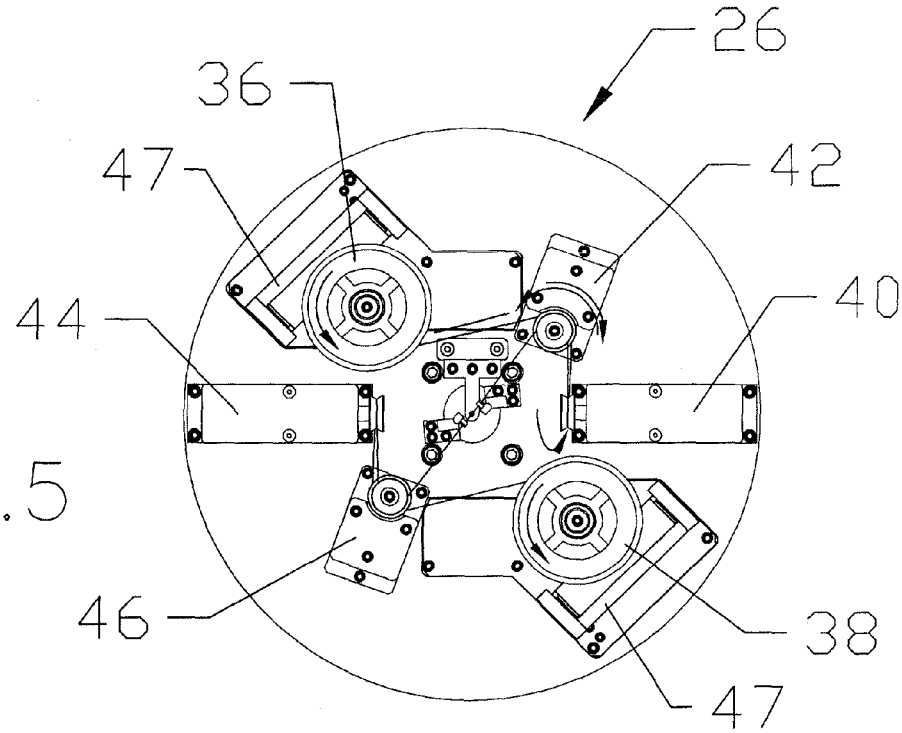
FIG. 5 is a right side view of the winding module showing the wire (filament) feed spools and their respective load cells and dancers, and the counterbalance mechanisms.
Figure 6:
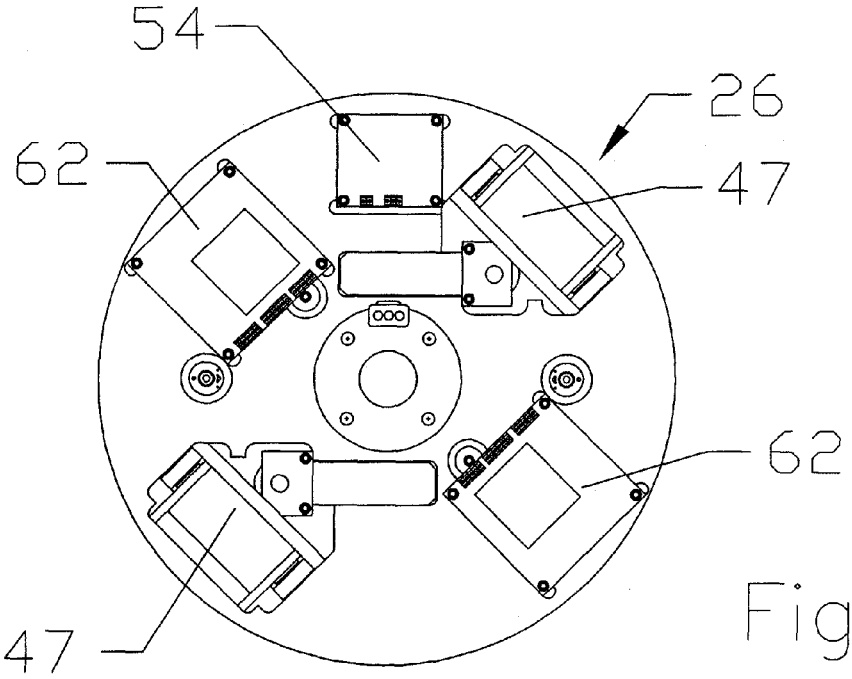
FIG. 6 is a left side view showing the embedded controllers of the filament spools, tensioner, and balancer.

The present invention is a continuous winding machine 10. The mechanical structure of the winding machine 10 can best be understood with reference to FIGS. 1-6. The winding machine 10 is installed on a movable mounting table 12. A touchscreen 14 enables the user to easily program the various operations performed by the machine 10 by choosing a pre-installed manufacturing recipe, and/or creating modified recipe settings.

The central element of the product being manufactured by the winding operation is a mandrel 16, the core of the wound product. The mandrel 16 is fed into the winding machine 10 from a mandrel supply assembly 18. The mandrel 16 is fed off a mandrel supply spool 20, across a first dancer 22, and then across a first load cell 24 around the pitch drive 48 and over a second load cell 32 associated with a mandrel takeup spool 28.

The mandrel 16 is then fed into the cylindrical housing of the winding module 26. After the mandrel 16 has passed through the winding module 26, the mandrel 16 is collected on the mandrel takeup spool 28 as the finished product. The mandrel takeup spool 28 has an associated second dancer 30 and the second load cell 32. The second load cell 32 is mounted to the left of the winding module 26. The mandrel takeup spool 28 and the second dancer 30 are contained in a sliding takeup assembly 34. The takeup assembly 34 is mounted on slide tracks so that the assembly 34 can be easily moved to facilitate loading of the machine.

The winding module 26 is shown in detail in FIG. 5. In the embodiment illustrated, a first filament spool 36 and a second filament spool 38 are utilized. While any number of filament feed spools could be chosen, in the preferred embodiment, two spools 36, 38 are utilized. Because the winding module 26 spins at high speed during the winding operation, a pair of spools is chosen so that the module 26 can be more easily balanced. A third dancer 40 and a third load cell 42 are associated with the first filament spool 36. Similarly, a fourth dancer 44 and a fourth load cell 46 are associated with the second filament spool 38.

A counterbalance mechanism 47, a device comprising a movable weight, is associated with each filament spool 36, 38, and is controlled by the respective embedded controller 62. The counterbalance mechanisms keep the winding module 26 in balance as material is used off the filament supply spools 36, 38. A vibration sensor, accelerometer 60 in communication with the PLC, detects any vibration that is present during operation of the machine 10. When any vibration is detected by the accelerometer 60, the PLC commands the embedded controller to adjust the counterbalance mechanism 47 to correct the weight distribution to eliminate the vibration.

Machine vision using an angle sense camera 66 is used to monitor the filament winding angle on the mandrel 16. To enable the machine vision that is used to detect winding angle, the camera 66 is installed with a backlight 68 in a position that allows the camera 66 to monitor the winding angle of the filaments on the mandrel 16. The winding angle information gathered via machine vision is displayed on a vision monitor 50, and is sent to the PLC, enabling the PLC system to adjust the electronic gearing to control winding pitch.

The winding pitch of the filaments onto the mandrel 16 is defined by the feed rate of the mandrel 16 per revolution of the winding module 26, which is controlled by the relative speeds of a pitch drive servo motor 48 and a rotation servo motor 56. A rotation sensor 58 triggers the angle sense camera 66 to record the winding angle while the filaments are in a viewable location. The PLC system uses that angle information to define a gearing ratio between the pitch drive servo motor 48 and the rotation servo motor 56. The pitch drive servo motor 48 drives the mandrel supply spool 18, and the rotation servo motor 56 rotates the winding module 26. When the proper gearing ratio is established, the pitch drive servo motor 48 advances the mandrel 16 at a feed rate that is synched with the speed at which the rotation servo motor 56 rotates the winding module 26 so as to obtain the desired winding pitch.

In order to reduce wiring in the machine, power is supplied to moving parts via an oscillator and a transformer with a stationary primary coil and a movable secondary coil. As can be seen in FIG. 3 and, in the preferred embodiment a rotary transformer 52 and a transformer oscillator 53 are used to form the interface between the main DC power supply of the machine and a rotating power supply 54 that is included with each rotating mechanism.

Figure 7:
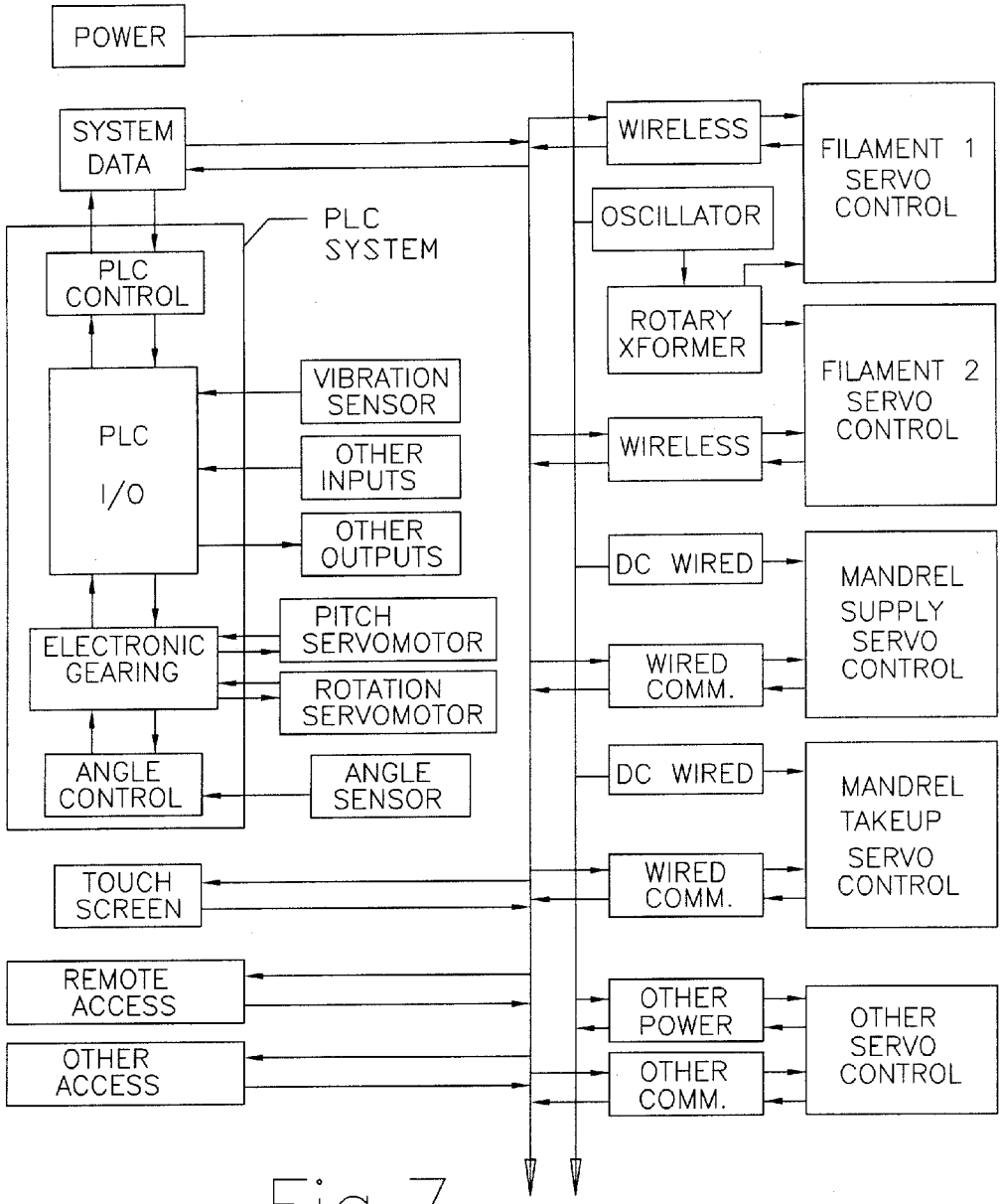
FIG. 7 is a block diagram of the control system for the winding machine utilizing multiple closed loop feedback systems.
Figure 8:
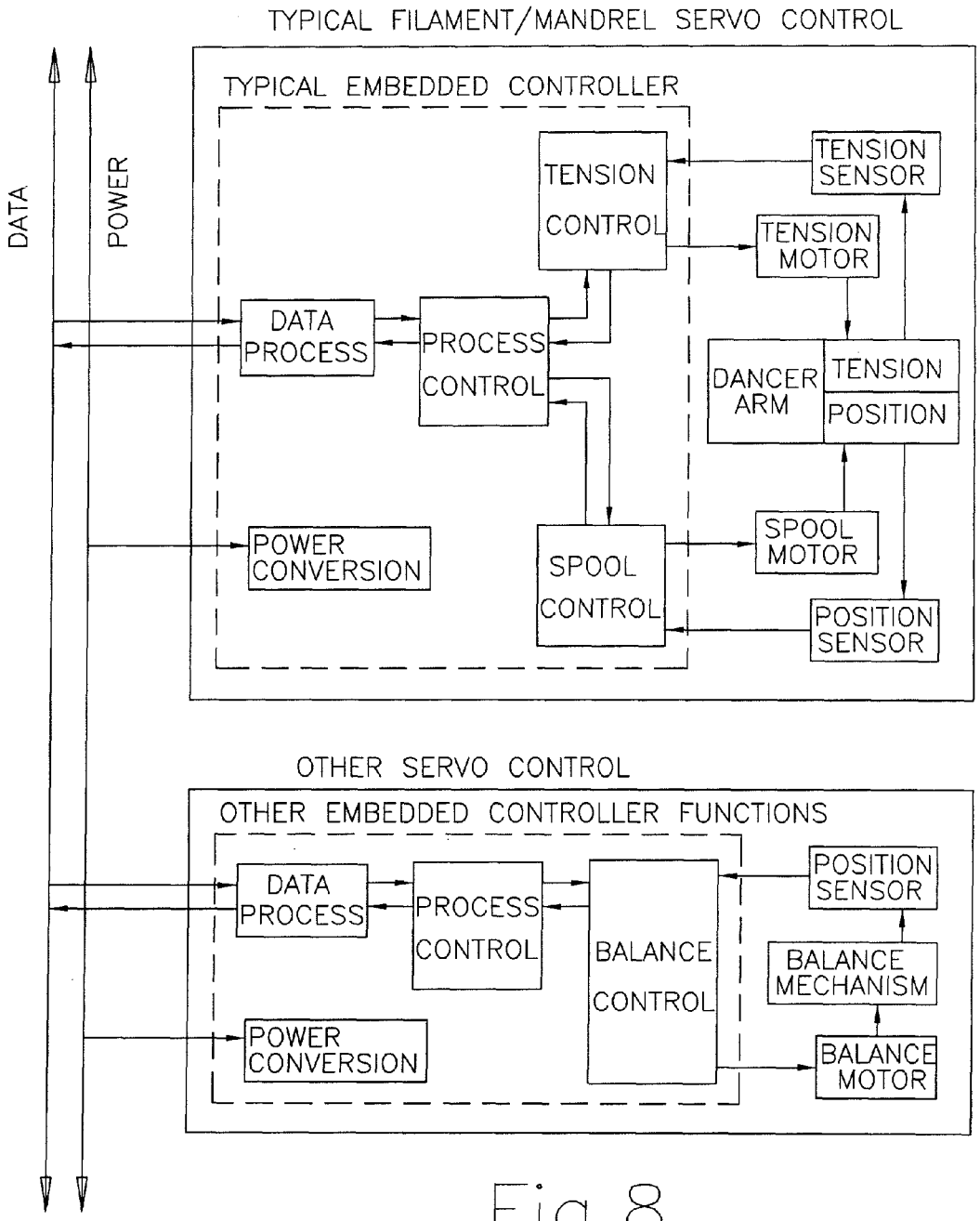
FIG. 8 is a block diagram showing the embedded controllers in greater detail.

Operation of the control system of the winding machine 10 can best be understood with reference to FIG. 7, a block diagram of the overall control system of the winding machine 10, and to FIG. 8, a more detailed block diagram of the closed loop servo control systems. The control system is a key element that enables the superior tension and angle control produced by the winding machine 10.

Tension of the wires and mandrel used in the machine is controlled to 0.1 gm. Due to the small sizes of wires used in the winding machine—filaments as small as 0.0004 in. diameter with a 0.001 in. diameter mandrel—the tension control is critical to avoid breakage.

Because pitch tolerances of ±0.0001 in. are not uncommon in the devices produced by the winding machine 10 of the present invention, the control system must use an electronic gearing servo system for fast and precise control of the filament and mandrel feeds. The angle sense camera 66 senses the wire angle to 0.01° and controls the wire angle to 0.05°. To adjust preload, or stiffness, of the wound coil product, a back-angle makes the pitch closed, (closed pitch meaning the pitch is equal to the filament diameter so that there is no spacing between wraps), thereby making the coil stiffer.

Each of the wire dispensing elements of the winding machine 10, the mandrel supply spool 20, the mandrel takeup spool 28, each of the filament spools 36 & 38, and the winding module 26 itself, all employ closed loop feedback systems to control their motion. Any number of filament spools can be utilized in the machine. In the preferred embodiment, two spools 36 & 38 are used due to balancing considerations. For illustrative purposes, FIG. 7 shows the control elements for the mandrel spools and for two filament spools.

The PLC system controls the overall operation of the winding machine 10. Multiple winding settings are stored as recipes in the PLC, and are accessed by the user through the touch screen. It should also be noted that access to the PLC can be provided by many known data transmission means, such as wireless, or even telephone access. For wireless communications, a stationary antenna 64 is included in the winding machine 10 (shown in FIG. 2). In the preferred embodiment, the antenna 64 enables the PLC to communicate with the two embedded controllers that spin with the winding module 26.

The user can program and store settings for as many combinations of winding pitch, distance, tension, angle, and speed as are desired. Because of the continuous nature of the winding machine 10, the length of the product is limited only by the size of the mandrel and filament supply spools 16, 36, 38. Multiple products can be produced without interrupting the operation of the machine, most readily by programming visible separation points between the various windings on the continuous mandrel.

Each wire dispensing element in the winding machine 10 has an associated dancer to apply tension and to detect slack, or the free length between the spool and its associated guide pulley. Each dancer has a position sensor and a servo-adjusted spring to apply tension to the wire. Each wire dispensing element also has an associated element to detect tension, a load cell in the preferred embodiment. Many types of position, tension, and motion sensors known in the art may be utilized while retaining the teachings of the present invention. In the preferred embodiment, optical interrupt, Hall Effect sensors, and load cells are utilized most often.

The information from the sensors associated with the pitch drive servo motor 48 and the rotation servo motor 56 is transmitted to the PLC. The PLC uses that information to generate the necessary angle control (using data from angle sense camera 66) and electronic gearing speeds for the pitch drive servo motor 48 and for the rotation servo motor 56 so that the desired winding characteristics are created in the product. The data fed from the PLC to the pitch drive servo motor 48 and the rotation servo motor 56 causes those elements to make the necessary adjustments—servo motor advance, pitch drive advance, etc.—for the desired pitch of the product.

The winding machine 10 operates to very tight tolerances as described in preceding sections above. In order to maintain those tolerances, the winding machine 10 must communicate required motion control information to the wire dispensing elements in microsecond time frames. Ordinary control systems that use control instructions from a PLC through common communication means are simply too large and require too may wires. An optimal control system must use a minimal number of wires while maintaining high speed communication. To do this, the continuous winding machine 10 of the present invention utilizes embedded controllers 62 for the mandrel supply 18 and takeup 28 spools, and for the high speed (in excess of 1500 rpm) rotating filament supply spools 36, 38. The embedded controllers 62 are integral to the wire dispensing elements with which they are associated. Since the embedded controllers 62 are mounted directly onto the elements they control, the embedded controllers 62 associated with the filament spools 36, 38 rotate with the winding module 26.

Each of the wire dispensing elements—the mandrel supply spool 20, the mandrel takeup spool 28, and the filament supply spools 36, 38—has an associated dancer and load cell, each with sensors that provide position information to a closed loop tension control unit. A first servo loop in each tension control unit maintains slack in response to the dancer position readings. A second servo loop in each tension control unit maintains tension in response to the tension readings from the load cells. All the circuitry required for the slack and tension control for each closed loop tension control unit, and therefore each wire dispensing element, is self-contained in an associated embedded controller 62. The circuitry required for the operation of the wire dispensing elements is therefore local to each dispensing unit, significantly reducing the number of wires required and the communication time for the feedback loops.

Each of the embedded controllers 62 is in communication with the PLC, but only to receive initial program instructions from the winding recipes stored in the PLC. The embedded controllers 62 do send operating information to the PLC, but the information is for display purposes and fault monitoring only, enabling the operator, through the PLC, to track the operation of the machine. The only interaction the PLC has with the tension and slack servo loops of the tension control units is if the data received from the tension control loops show tension or slack measurements outside acceptable operating limits. In this case, the winding machine 10 is shut down to correct whatever is causing the operating error. This situation very rarely occurs.

As shown in FIG. 7, the communication between the embedded controllers 62 and the PLC can be either wireless, as in the case of the filament spools 36, 38, or hard wired as with the mandrel supply and takeup spools 20, 28.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

What is claimed is:

1. A tension control unit for a wire dispensing mechanism comprising:

a wire dispenser;

at least one dancer; and at least one load cell, wherein each dancer and each load cell include sensors that provide position and tension information to the tension control unit so that the tension control unit is a closed loop system that maintains a desired tension in a wire in the wire dispenser.

2. The tension control unit as defined in claim 1, wherein a first servo loop in the tension control unit maintains slack in response to dancer position readings, and a second servo loop in the tension control unit maintains tension in response to tension readings from the load cell.

3. The tension control unit as defined in claim 1, wherein the wire dispensing mechanism includes a power supply interface including a transformer with a stationary primary coil and a movable secondary coil.

4. The tension control unit as defined in claim 1, wherein circuitry required for slack and tension control of the closed loop tension control unit is self-contained in an embedded controller mounted on the wire dispenser, the circuitry required for operation of the wire dispenser therefore being local to the wire dispenser.

5. The tension control unit as defined in claim 4, wherein a first servo loop in the tension control unit maintains slack in response to dancer position readings, and a second servo loop in the tension control unit maintains tension in response to tension readings from the load cell.

6. The tension control unit as defined in claim 4, wherein the wire dispenser includes a power supply interface including a transformer with a stationary primary coil and a movable secondary coil.

7. The tension control unit as defined in claim 4, wherein the embedded controller is in wireless communication with an overall control system of the tension control unit.

* * * * *